United States Patent [19]

Hukki

[11] 4,038,178

[45] July 26, 1977

[54] APPARATUS FOR CONTROLLING DISCHARGE OF CLASSIFIED SAND FROM A HYDRAULIC CLASSIFIER

[76] Inventor: Risto Tapani Hukki Otakallio 1A, 02150 Otaniemi, Finland

[21] Appl. No.: 629,067

[22] Filed: Nov. 5, 1975

[30] Foreign Application Priority Data

Nov. 19, 1974 Finland ..... 3339/74

[51] Int. Cl.[2] ..... B03B 5/66

[52] U.S. Cl. ..... 209/161; 209/465; 209/496; 209/208

[58] Field of Search ..... 209/155–161, 209/211, 491, 494–496, 463, 465, 208; 137/91, 92; 222/64

[56] References Cited

U.S. PATENT DOCUMENTS

| | | | |
|---|---|---|---|
| 1,265,734 | 5/1918 | Brunker | 209/155 |
| 1,705,351 | 3/1929 | Andrews | 209/158 |
| 1,716,309 | 6/1929 | Fournier | 209/158 X |
| 1,749,350 | 3/1930 | McQuail | 209/161 X |
| 2,749,928 | 6/1956 | Dowsett | 209/208 X |
| 3,412,858 | 11/1968 | Stone | 209/496 X |

FOREIGN PATENT DOCUMENTS

| | | | |
|---|---|---|---|
| 762,719 | 4/1934 | France | 209/208 |

*Primary Examiner*—Frank W. Lutter
*Assistant Examiner*—Ralph J. Hill
*Attorney, Agent, or Firm*—Kurt Kelman

[57] ABSTRACT

A hydraulic classifier for sand has a vessel of circular cross section about a vertical axis and tapers downward to an aperture in its bottom. A rotor is slowly rotated on a hollow shaft coaxially mounted in the vessel. It includes a hollow member conically tapering from an annular lower orifice upwardly spaced from the bottom aperture toward a smaller upper orifice, a flow tube mounted on the shaft for receiving liquid upwardly discharged from the upper orifice of the hollow member for upward flow, agitating blades projecting radially outward beyond the flow tube above the hollow member, and a nozzle on the shaft below the hollow member for forcing cleaned sand through the bottom aperture of the vessel by means of a flushing medium. A washing nozzle directs a liquid washing medium radially inward toward the conical hollow member intermediate the orifices of the same whereby washing medium is deflected into the flow tube and draws additional liquid from the upper orifice. The flow tube, hollow member, and lowermost portion of the shaft bound an annular path for downward movement of a suspension of sand fed to the vessel above the flow tube.

2 Claims, 1 Drawing Figure

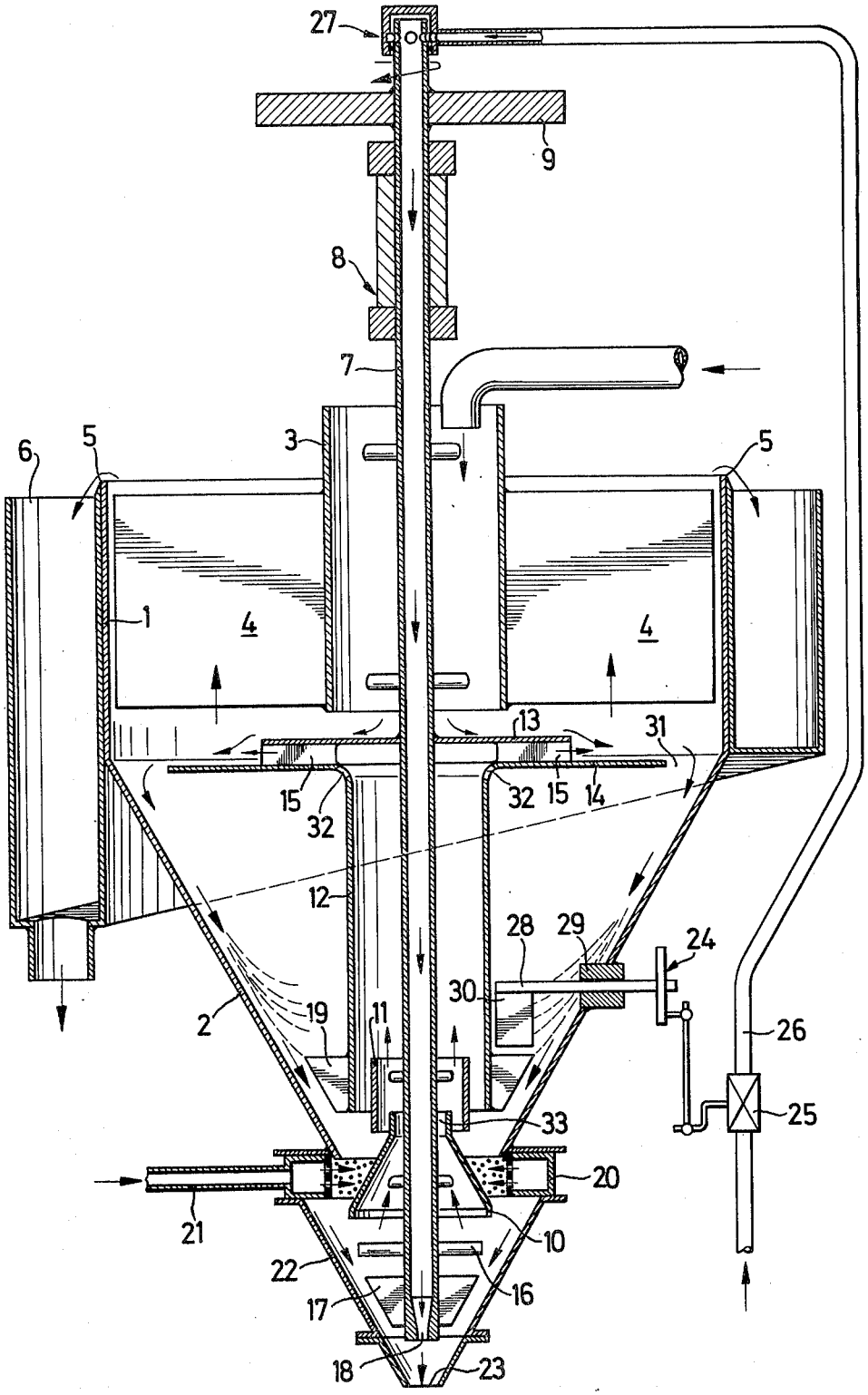
27
9
8
7
6
5
3
5
1
4
4
13
31
15
32
32
15
14
12
28
29
24
30
2
19
11
26
25
33
20
21
10
22
16
17
18
23

APPARATUS FOR CONTROLLING DISCHARGE OF CLASSIFIED SAND FROM A HYDRAULIC CLASSIFIER

This invention relates to the hydraulic classification of particulate material, and particularly to apparatus for classifying sand, and for discharging it from a conically tapering classifying vessel by gravity.

Sand is hydraulically classified in cone, rake, or spiral classifiers, but the particulate product discharged from conventional classifiers still contains large quantities of fines. It was considered impossible heretofore to maintain a uniform discharge of sand from a conical vessel through an open pipe by gravity.

It is an object of this invention to provide simple, effective, and dependable apparatus for continuously discharging sand under automatic control from a hydraulic classifier. An additional object is the separation of the discharged sand from entrapped fines.

The hydraulic classifier of the invention includes a cylindrical and/or conical vessel and a coaxial rotor in the vessel which keeps the impure sand as well as the cleaned sand in continuous rotary motion. The sand is cleaned in a washing device consisting essentially of a stationary, perforated ring discharging water through the sand against an upwardly tapering, conical member on the rotor which deflects the fluid into an ascending flow tube of the rotor. A rim of vanes on the flow tube imparts rotary motion to the descending, impure sand before it reaches the washing device. Similar vanes on the rotor shaft below the washing device keep the cleaned sand in rotary motion. The cleaned sand is discharged at an automatically controlled rate through a discharge aperture at the bottom of the classifier vessel by a stream of flushing medium discharged from the bottom end of the hollow rotor shaft.

The apparatus of the invention for discharging a sand product will be described hereinbelow with reference to the sole figure of the appended drawing which shows an embodiment of the invention in elevational section.

The vessel of the illustrated hydraulic classifier has an upper cylindrical section 1 and a coaxial, lower, conical section 2. The sand to be purified is supplied to a vertical feed tube 3 centered in the upper section 1 and carrying radial vanes 4. A suspension of fines overflows over the upper rim 5 of the cylindrical section 1 into a collecting trough 6. The feed tube 3 is mounted on a rotor shaft 7 which is supported in a bearing 8 for rotation about the vertical axis of the vessel 1, 2 and normally rotated by a drive wheel 9 at a low speed, such as 60 r.p.m. Near its lower end, the shaft 7 carries a coaxial, frustoconical, hollow member 10 tapering from a lower, annular orifice to a smaller, upper, annular orifice 33. The upper end of the member 10 is received with radial clearance in the bottom part of a coaxial guide tube 11 on the shaft 7. The top part of the guide tube 11 is coaxially received with radial clearance in the lowermost portion of flow tube 12 mounted on the shaft 7. Radial flanges 13, 14 on the shaft 7 and on the tube 12 axially bound a gap open in a radially outward direction and communicating with the bore of the tube 12 and are connected by radial vanes 15 in the gap. The lower end portion of the shaft 7 below the member 10 carries radial mixing rods 16 and agitating blades 17. The bore of the hollow shaft 7 terminates in an axially downwardly directed nozzle 18. Vertical blades 19 project radially from the flow tube 12 toward the conical vessel section 2.

An annular washing nozzle 20 is fixedly mounted on the classifier vessel on the same axial height as the member 10 on the rotor. The nozzle 20 receives washing liquid through a supply pipe 21, and discharges the washing liquid radially through a multiplicity of discharge openings, preferably about 100, against the conical outer wall of the member 10. The bottom of the classifier vessel is formed by a cone 22 tapering downward toward an aperture 23 below the nozzle 18.

The discharge of clean sand from the aperture 23 is controlled by a sensing device 24 linked to a valve 25 in a supply pipe 26 for a flushing liquid. The pipe communicates with the top end of the shaft 7 through a rotary connector 27. The horizontal shaft 28 of the sensing device 24 is journaled in a bearing 29 in the wall of the vessel section 2 and carries a fixedly mounted vane 30. The vane 30 is located about the rotating blades 19 with little axial clearance. The outer end of the shaft 28 is linked to the valve 25.

The apparatus operates as follows:

A pulp of sand and liquid descending through the tube 3 is deflected radially outward from the bottom of the tube by the flange 13 and by the portion of the flange 14 radially projecting beyond the flange 13 toward an annular opening 31 between the flange 14 and the inner wall of the conical vessel section 2 while an ascending suspension of fines overflows the rim 5 into the trough 6. The heavier fraction of the fed sand which is not carried along by the fines descends by gravity along the conical vessel wall and is brought into rotary motion by the blades 19 which prevent accumulation of a stagnant sand layer on the vessel walls.

When the descending sand, still impure, reaches the narrow annular zone of the washing device 10, 20, it is washed by liquid sprayed from the nozzle 20 which is deflected upward by the conical wall of the member 10 and flows through the guide tube 11 into the flow tube 12. Upward liquid movement in the tube 12 is enhanced by the suction effect of the rotating vanes 15 acting in the manner of a centrifugal pump. Lighter sand grains are carried along by the ascending liquid. The coarsest grains settle out of the liquid when the velocity of the latter decreases in the wider tube 12. The lighter fraction is discharged from the gap between the flanges 13, 14.

Fractionation of the sand thus occurs mainly in a body of liquid circulating within the vessel section 2 in an ascending path through the tube 12 and a descending path through the opening 31. The intensity of the washing action depends on the ratio of water supply to the nozzle 20 and sand supply to the feed pipe 3. It is enhanced by openings 32 at the root of the flange 14 through which sand suspension can be drawn from the underside of the flange to its top. A small amount of suspension collecting below the hollow member 10 is also discharged from the upper orifice 35 of the member 10 into the guide tube 11. Clean, course sand ultimately collects in the cone 22 where it is kept in rotary motion by the rods 16 and agitating blades 17.

The agitating blades 19 on the tube 12 cooperate with the vane 30 as the driven or input blades in a hydraulic, automotive coupling cooperate with blades on an output wheel of the coupling. The torque transmitted from the blades 19 to the vane 30 of the sensing device depends on the viscosity of the liquid therebetween and thus increases with the amount of sand suspended in the water near the vane 30.

At minimal transmitted torque, the valve 25 is closed or almost closed. At high torque, the valve 25 is fully open, and the flushing liquid discharged from the nozzle 18 forces the sand out of the classifier vessel from the aperture 23. The size of the aperture remains constant, and the discharge rate is controlled entirely by the flow of the flushing medium.

The shaft 7 and the associated rotor elements may be rotated in either direction, and wear of the apparatus may be equalized by changing the direction of rotation periodically. It will be appreciated that the utility of the apparatus is not limited to the particulate material specifically referred to above.

I claim:

1. An hydraulic classifier including means for discharging a particulate product comprising:

a. a vessel tapering in a downward direction and having means for discharging fines at the top and a bottom formed with an aperture;

b. a rotor in said vessel including 1. a shaft having an upright axis,
2. drive means for rotating said shaft about said axis,
3. an upwardly tapering, hollow member mounted on said shaft and upwardly spaced from said aperture, said member having an annular lower orifice and an annular upper orifice smaller than said lower orifice,
4. a flow tube mounted on said shaft for receiving liquid upwardly discharged from said upper orifice for upward flow,
5. agitating means projecting radially outward beyond said flow tube above said hollow member, and
6. means on said shaft below said hollow member for forcing cleaned particular product through said aperture;

c. washing means on said vessel for directing a liquid washing medium radially inward against said hollow member intermediate said orifices thereof, whereby said washing medium is deflected into said flow tube and draws additional liquid from said upper orifice, 1. said flow tube, said hollow member, and the lowermost portion of said shaft bounding an annular path for downward movement of a suspension of particulate material in liquid in a radially inward direction, said path being bounded by said vessel in a radially outward direction,
2. said agitating means projecting into said path; and d. feeding means for feeding particulate material to a portion of said vessel above said flow tube.

2. Apparatus as set forth in claim 1, wherein said shaft is hollow and has an opening directed toward said aperture, said means for forcing cleaned particular product through said aperture include a conduit communicating with the interior of said hollow shaft, flow control means in said conduit for controlling the flow of a flushing liquid out of said opening of the shaft, and sensing means in said path for detecting the viscosity of said suspension in said path, said sensing means being operatively connected to said flow control means for adjusting the flow of said flushing liquid in accordance with the sensed viscosity.

* * * * *